US006357844B1

(12) United States Patent
Müterthies et al.

(10) Patent No.: US 6,357,844 B1
(45) Date of Patent: Mar. 19, 2002

(54) PARTITIONING SYSTEM

(75) Inventors: Ralf Müterthies, Löhne; Stefan Rüter, Bad Oeynhausen; Carsten Meyer, Bielefeld; Gerhard Schröder, Bad Oeynhausen; Jörg Aufderheide, Spenge, all of (DE)

(73) Assignee: Paul Hettich GmbH & Co., Kirchlengren (DE)

( * ) Notice: Subject to any disclaimer, the term of this patent is extended or adjusted under 35 U.S.C. 154(b) by 0 days.

(21) Appl. No.: 09/663,186

(22) Filed: Sep. 15, 2000

(30) Foreign Application Priority Data

Sep. 17, 1999 (DE) ..... 199 44 641

(51) Int. Cl.[7] ..... A47B 88/00

(52) U.S. Cl. ..... 312/348.3; 312/330.1; 220/543

(58) Field of Search ..... 312/330.1, 348.1, 312/348.2, 348.3, 348.5, 187, 193; 220/529, 534, 543, 544, 545, 552

(56) References Cited

U.S. PATENT DOCUMENTS

| | | | | | |
|---|---|---|---|---|---|
| 1,940,048 | A | * | 12/1933 | Cutler | 312/348.3 X |
| 2,663,449 | A | * | 12/1953 | Smart | 220/543 |
| 3,029,357 | A | | 4/1962 | Williams | |
| 3,549,301 | A | | 12/1970 | Harris et al. | 312/330.1 |
| 3,729,246 | A | | 4/1973 | Harrell et al. | 312/330.1 |
| 3,892,451 | A | * | 7/1975 | Bruins | 312/348.3 |
| 4,081,100 | A | * | 3/1978 | Presby | 220/544 |
| 4,102,470 | A | * | 7/1978 | Timmons | 220/543 |
| 5,197,791 | A | | 3/1993 | Domenig | 312/348.1 |
| 5,370,454 | A | | 12/1994 | Domenig | 312/348.1 |
| 5,433,518 | A | | 7/1995 | Skov | 312/348.1 |
| 6,073,794 | A | * | 6/2000 | Bidot | 312/348.3 X |

FOREIGN PATENT DOCUMENTS

| | | | | |
|---|---|---|---|---|
| CH | 298092 | * | 4/1954 | 312/348.3 |
| DE | G 73 17 344.1 | | 5/1973 | |
| DE | 2431462 | * | 1/1975 | 312/348.3 |
| DE | 2437550 | * | 2/1976 | 312/348.3 |
| DE | GM 79 00 396 | | 6/1980 | |
| DE | 2944683 | * | 5/1981 | 312/348.3 |
| DE | G 83 33 251.0 U | | 3/1984 | |
| DE | 40 16 452 A1 | | 9/1991 | |
| DE | G 93 11 493.1 U | | 11/1993 | |
| DE | G 94 07 813.0 U | | 9/1994 | |
| DE | 19726466 A1 | | 12/1998 | |

* cited by examiner

*Primary Examiner*—James O. Hansen
(74) *Attorney, Agent, or Firm*—Barnes & Thornburg

(57) ABSTRACT

A partitioning system, particularly for drawers (1), comprises two lateral side wall elements (5, 6, 8, 12) arranged on a drawer bottom, between which a space is provided; a positionable separating wall (10) extending between the wall elements (5, 6, 8, 12); and devices for fixing the separating wall (10) between the wall elements (5, 6, 8, 12) at a desired position. The separating wall (10) is held in a first lifted position displaceable between the wall elements (5, 6, 8, 12) in order to be able to align it inside the drawer (1) into the desired position. When the positionable separating wall (10) is moved into a second lowered position between the wall elements (5, 6, 8, 12), the positionable separating wall is held in a fixed manner and is no longer displaceable.

15 Claims, 14 Drawing Sheets

PARTITIONING SYSTEM

BACKGROUND AND SUMMARY OF THE INVENTION

The invention relates to a positionable partitioning system located between two side walls of drawers. Such a partitioning system is usually used in drawers or construction kits in order to partition the interior of a drawer into smaller units and create new organizing units for smaller objects.

Filed contemporaneously herewith are six United States patent applications, commonly assigned to Paul Hettich GmbH & Co.:

| INVENTOR(S) | TITLE | ATTY DOCKET |
|---|---|---|
| Müterthies, Rüter, et al. | Fastening Arrangement | 824/36770 |
| Müterthies, Rüter, et al. | Fastening Arrangement | 824/36771 |
| Müterthies, Rüter, et al. | Mounting Unit | 824/36772 |
| Müterthies, Rüter, et al. | Fastening Arrangement | 824/36773 |
| Müterthies, Rüter, et al. | Pull-out Slide Set | 824/36774 |
| Müterthies, Rüter, et al. | Fastening Arrangement | 824/36785 |

The claims, drawings and specification of each of the foregoing applications is hereby specifically incorporated by reference into this specification as if set forth verbatim herein.

U.S. Patent Document U.S. Pat. No. 3,549,310 shows a drawer which has a partitioning system which can be fastened on two opposite side walls of the drawer. For this purpose, swivellable clamping elements are provided which can be hung by means of a curvature into a groove of a side wall. Because the groove is closed in the upper area by a wall element, the upper edge of the curvature of the clamping element rests against the wall element so that, in the preassembled position, the clamping element projects diagonally toward the interior. In addition, ribs are constructed on the clamping elements, into which ribs a front edge of the separating wall can be inserted. In order to mount a separating wall between the clamping elements, the clamping elements are first hung in and preassembled in order to subsequently be pressed by the separating wall under a certain prestress against the side walls.

In the case of the known partitioning system, it is a disadvantage that the separating wall cannot be aligned in the drawer directly into the desired position, but only the lateral clamping elements can be displaced in the preassembled condition. Particularly for more accurate alignments of the separating wall, this separating wall must then be removed from the drawer in order to then reposition the clamping elements. This approach is cumbersome and requires high expenditures. In addition, during each clamping-on of the clamping elements, the material of the side walls and of the clamping elements is stressed, which leads to a relatively high wear and can cause scratches on the side walls, because the clamping elements are made of metal.

It is therefore an object of the present invention to provide a partitioning system for boxes, particularly drawers, which can be mounted as easily as possible and has only a few individual components. In addition, the partitioning system should only slightly stress the individual components and should flexibly be usable for drawers of different constructions.

This object is achieved by means of a partitioning system which positions a partially inserted partition in the drawer and with fixation occurring by fully inserting the partition. According to the invention, a partitioning system is provided, particularly for drawers, having two lateral wall elements which are arranged on a floor bottom of the drawer, between which wall elements a space is provided. A separating wall extends between the wall elements and has devices for fixing the location of separating wall between the wall elements. The separating wall is held in a first lifted position displaceably between the wall elements and when moved to a second lowered position, the separating wall is held in a fixed manner between the wall elements. This construction permits a mounting of the separating wall in a drawer, in which case the separating wall can be displaced and aligned in the slightly lifted position without having to be removed completely from the drawer. This simplifies the mounting operation, particularly when the separating wall is to be moved to a certain position because of the size of objects to be deposited in the drawer.

In a preferred embodiment of the invention, the separating wall is held in a fixed manner in the lowered position by means of clamping and friction forces so that during a mounting of the separating wall by its displacement into the lowered position, no additional mounting operations have to be carried out. Such clamping and friction forces can be generated in a simple manner if the wall elements extend from above in a downward direction diagonally (toward the interior) toward the bottom floor. As a result, the slope of the wall can be utilized for providing, during a lowering of the separating wall, the required holding forces for the fixing between the wall elements.

A simple construction of the partitioning system with only a few components is achieved if the devices for fixing the separating wall between the wall elements have clamping elements which can be fitted into a groove arranged on the wall elements. If, additionally, the separating wall can be fitted on the clamping elements, the partitioning system can be assembled rapidly.

According to a preferred embodiment of the invention, each clamping element has at least one sealing lip made of an elastic material on its side facing the wall element. As a result, a "hard" contact of materials, such as metal on metal, or hard plastic materials on one another, is avoided, because the elastic sealing lip is provided between the wall element and the clamping element. By means of this sealing lip, high holding forces can be generated without damaging the material of the wall elements or of the separating wall. Preferably, the separating wall has a sealing lip made of elastic material on the side facing the bottom floor, so that, in the lowered position, the separating wall additionally is securely held on the bottom floor, without the danger that the partition wall scratches the bottom.

A partitioning system which can be produced at reasonable cost if the separating wall can be fitted onto the clamping elements by laterally arranged holding elements which partially engage into the profile of the separating wall.

Another partitioning possibility is provided if the separating wall has devices for fastening an intermediate wall extending perpendicularly to the separating wall. The devices for fastening the intermediate wall preferably have an intermediate element which can be fitted onto the separating wall and on which the intermediate wall can be fixed. This permits a largely individual design of the interior of a drawer.

A rapid and precise mounting of the intermediate wall is achieved if this wall is held to be displaceable in a first lifted position on a separating wall, and the intermediate wall is held in a second lowered position in a fixed manner on the separating wall.

According to the invention, a drawer is also provided which has a displaceably disposed sliding bottom floor on which a front panel, two side walls and a rear wall are mounted, the drawer having a partitioning system according to the invention.

Other objects, advantages and novel features of the present invention will become apparent from the following detailed description of the invention when considered in conjunction with the accompanying drawings. 5

DESCRIPTION OF THE DRAWINGS

Figure 1:
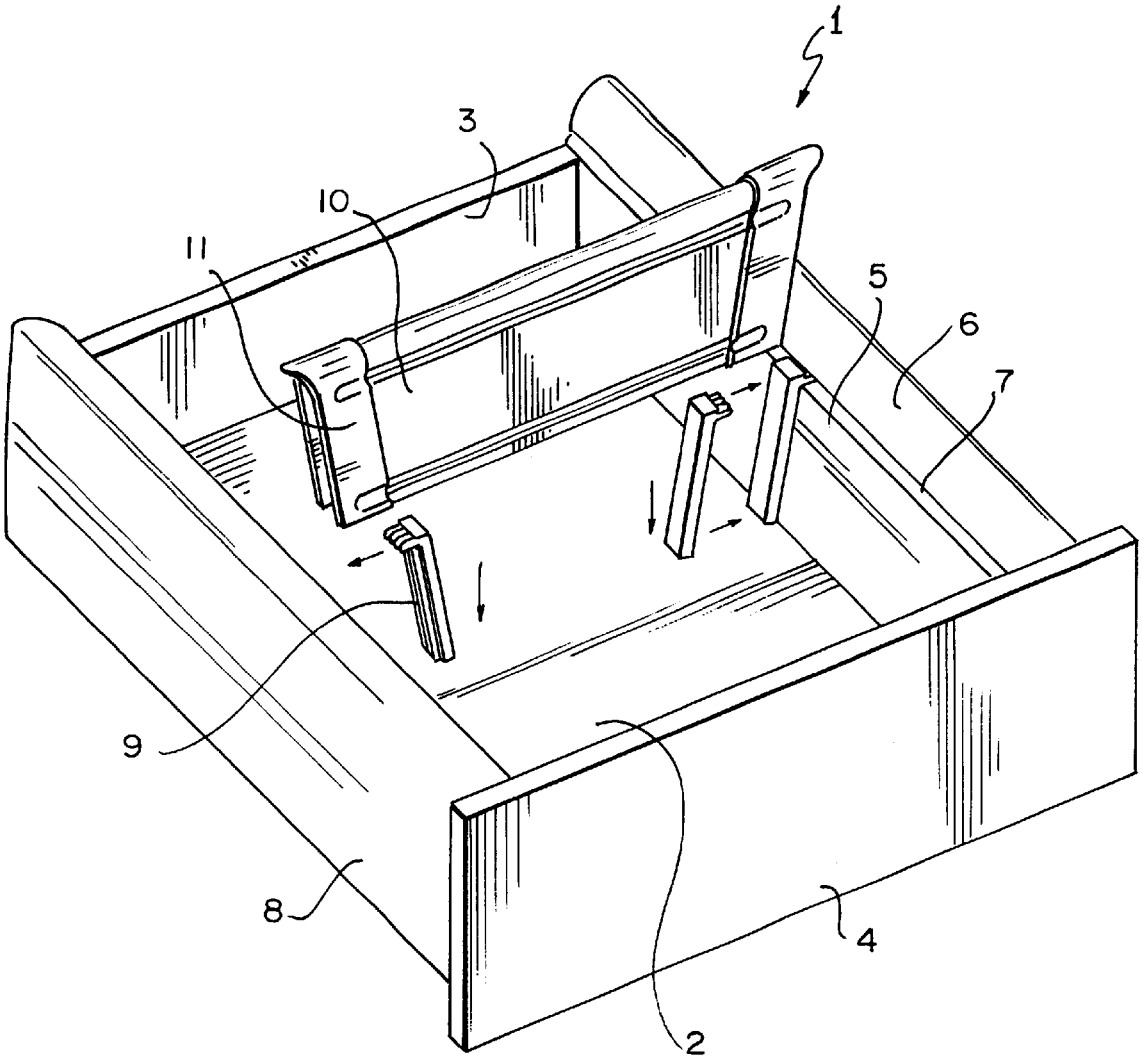
FIG. 1 is a perspective exploded view of a first embodiment of a partitioning system according to the invention in a drawer.
Figure 2A:
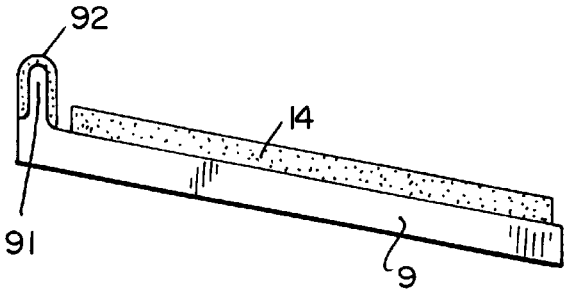
FIG. 2A to 2D are several views of a clamping element of the partitioning system.
Figure 2B:
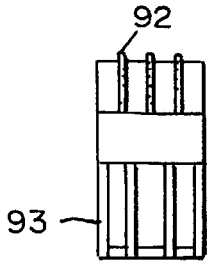
Figure 2C:
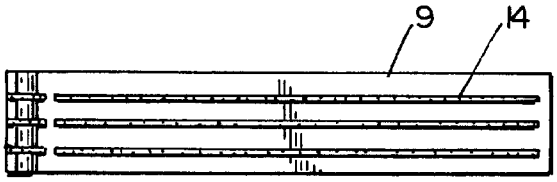
Figure 2D:
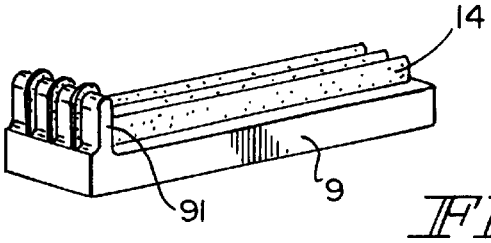

The partitioning system illustrated in FIG. 1 is arranged on a sliding bottom floor 2 of a drawer 1. The drawer 1 has a rear wall 3 and a front panel 4, between which several side wall or side wall elements 5, 6 and 8 are arranged on the right and the left sides of the drawer. Between the lower side wall element 5 and the upper side wall element 6, a groove 7 is formed which is shown only on the right side in FIG. 1 but also exists on the left side.

A clamping element 9 can be fitted into the groove 7 for fastening a separating wall 10 on the clamping element 9. For this purpose, the separating wall 10 is laterally provided with holding elements 11 which can each be fitted onto the clamping element 9.

As illustrated in FIGS. 2A to 2D, the clamping element 9 has a projecting clamping tip 91 which is surrounded by three elastic clamping lips 92. The clamping lips 92 are made of the same material as a sealing lip 14 on the longitudinal side of the clamping element 9. As illustrated in the frontal view of FIG. 2B, the clamping lips 92 project beyond the clamping tip 91 so that a certain elasticity exists when the clamping element 9 is clamped on. On the underside of the clamping element 9, several smoothly extending webs 93 are provided which, like the main body, are manufactured of a hard plastic material. The clamping element 9 therefore consists of two plastic materials and is produced by a two-component injection molding process.

Figure 3:
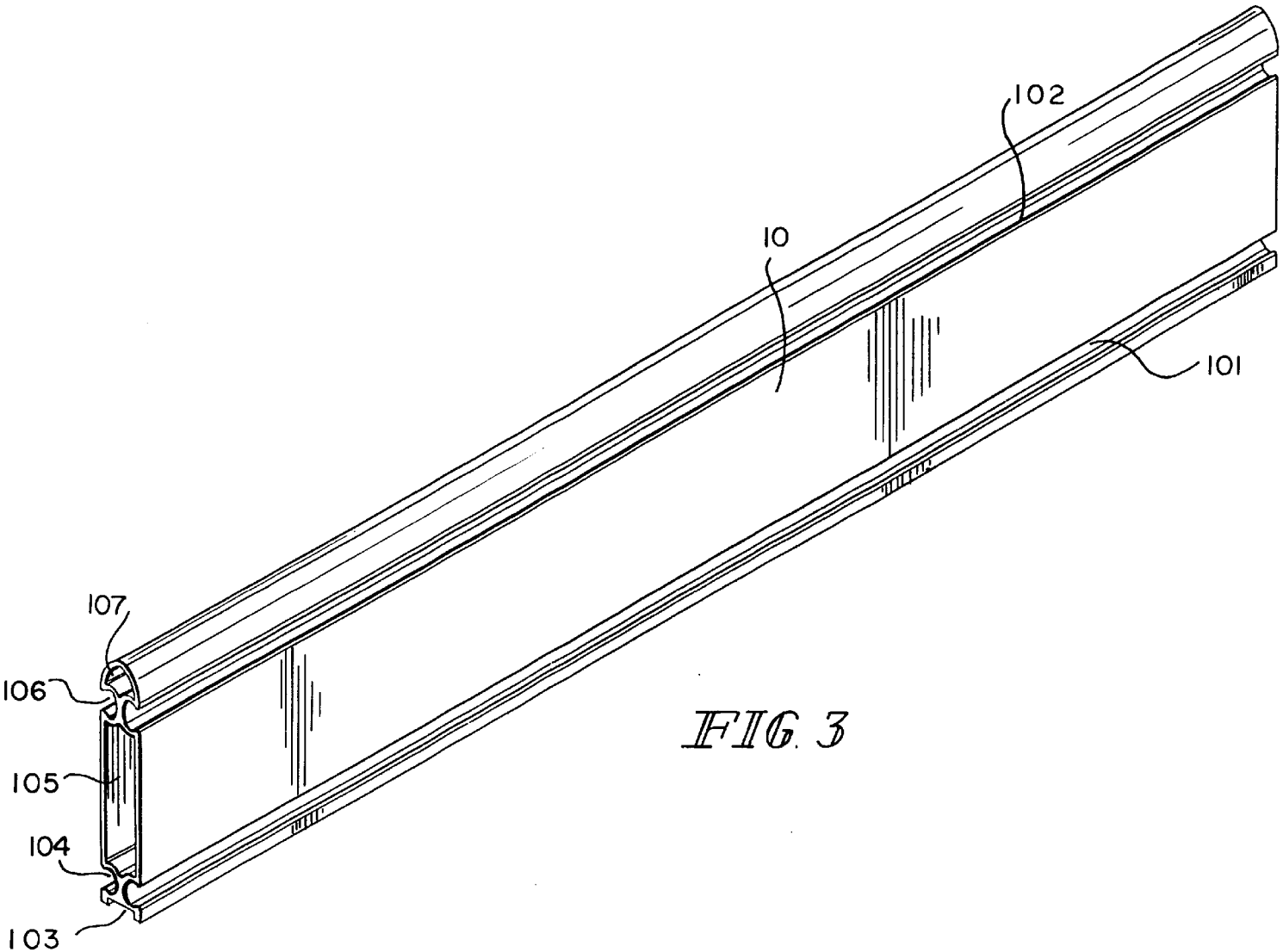
FIG. 3 is a perspective view of a separating wall of the partitioning system.

FIG. 3 shows the separating wall 10 of the partitioning system. The separating wall 10 formed of a metal profile has an upper groove 102 and a lower groove 101, which are provided as an identical construction also on the opposite side at reference numbers 106 and 104. The separating wall 10 is constructed as a hollow profile and comprises an upper chamber 107, a chamber 105 and a lower receiving device 103. The receiving device 103 facing the bottom and is provided with a glued-on sealing lip 103' (FIG. 6) made of an elastic material.

Figure 4C:
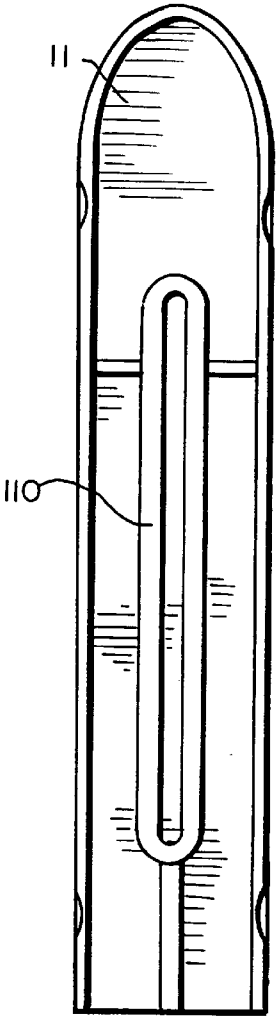
FIGS. 4A to 4C are several views of a holding element of the separating wall according to FIG. 3.
Figure 4B:
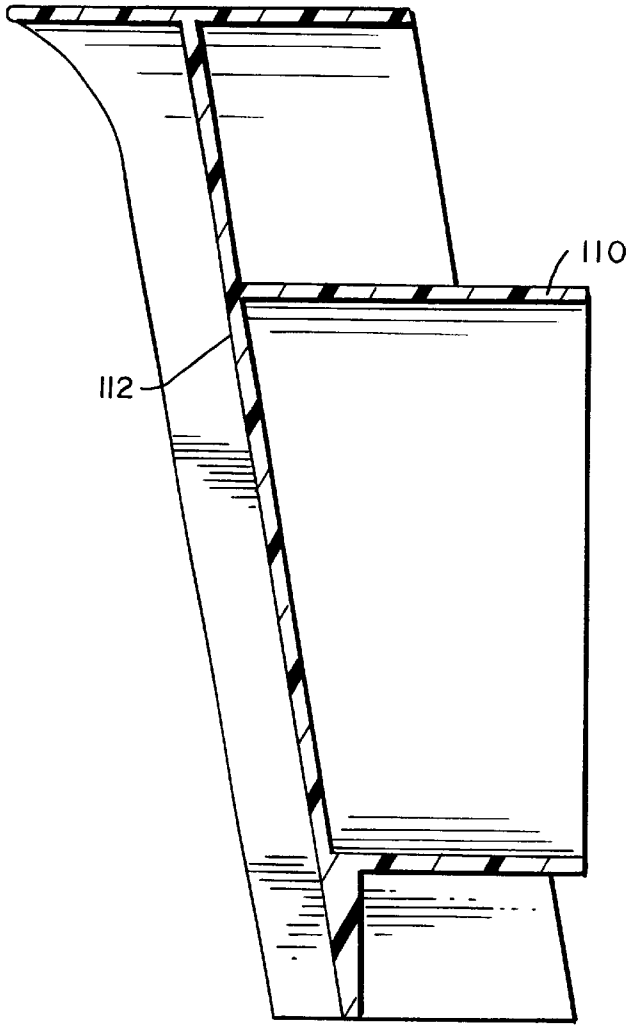
Figure 4A:
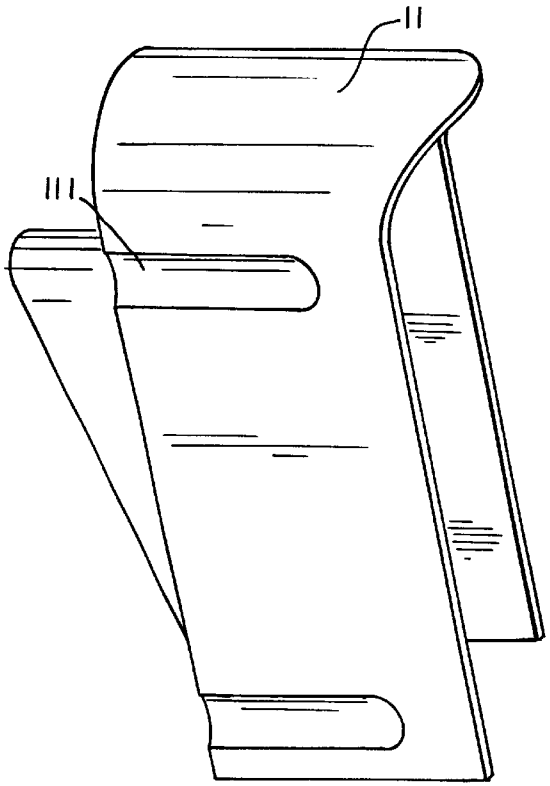

Holding elements 11 made of plastic material, which are illustrated in detail in FIGS. 4A to 4*c*, are fitted laterally onto the separating wall 10. The holding element 11 comprises a channel 110 which can be fitted into the chamber 105 of the separating wall and a diagonally extending interior wall 112 being used as a stop. The holding element 11 has notches 111 in the area of the grooves 101, 102, 104 and 106.

Figure 5A:
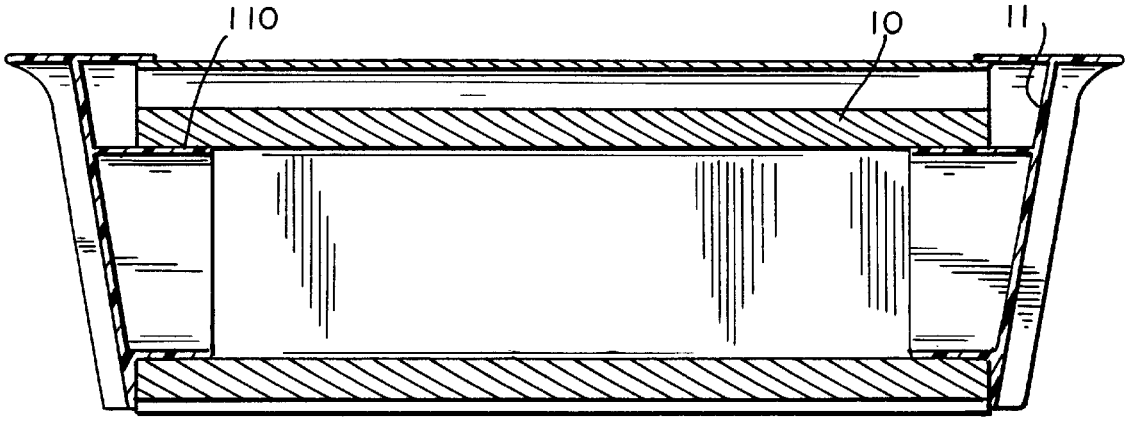
FIGS. 5A to 5C are several views of the separating wall with laterally arranged holding elements.
Figure 5B:
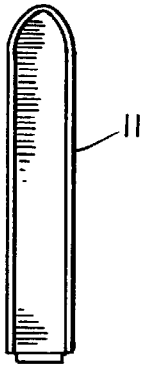
Figure 5C:
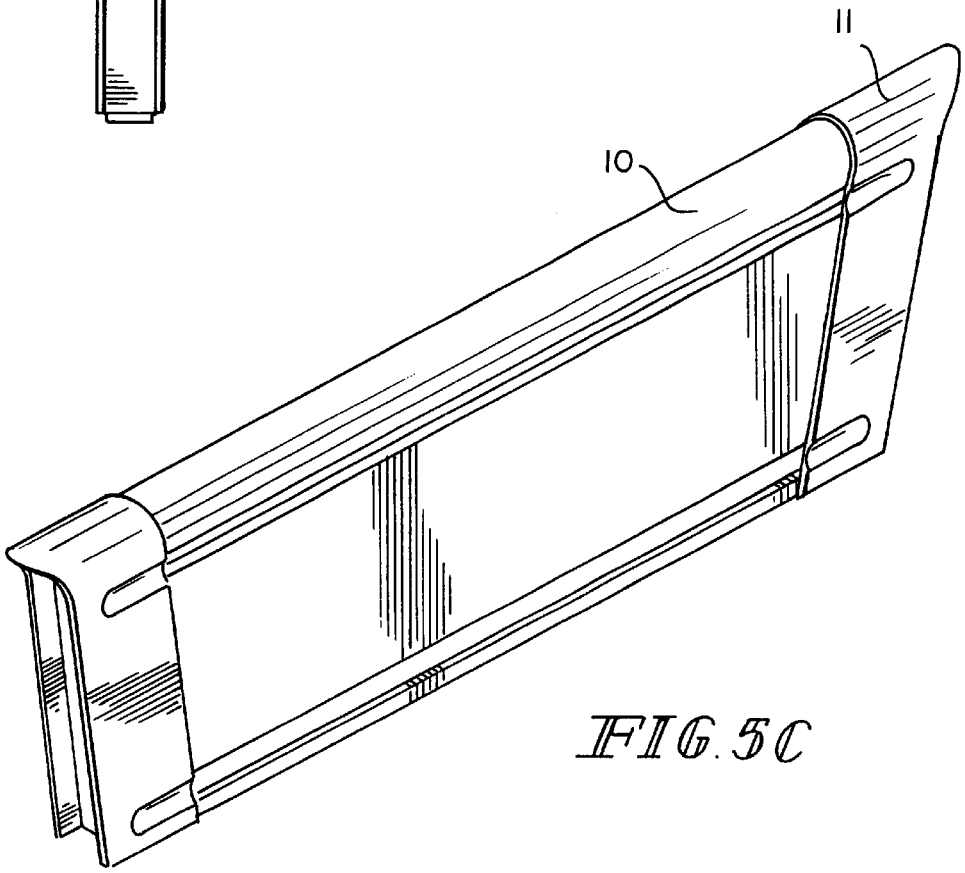

Although the separating wall 10 is cut off straight at the sides, the separating wall 10 can be fastened by means of the holding elements 11 on diagonally extending clamping elements 9 or side walls (FIG. 5A).

Figure 6:
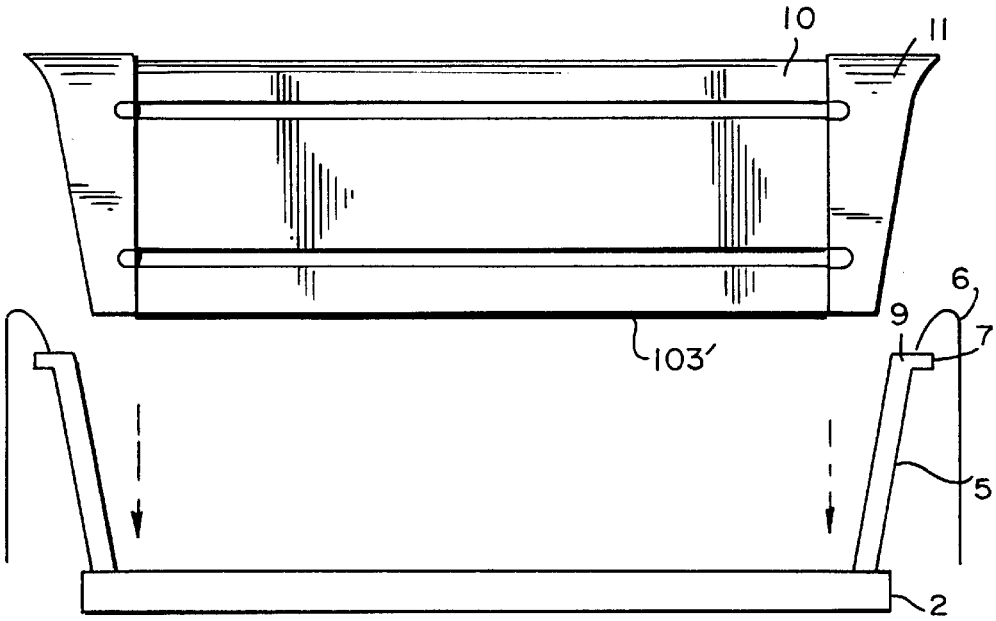
FIG. 6 is a frontal view of the separating wall of the partitioning system before the mounting.

The mounting operation of a separating wall 10 will be explained with respect to FIGS. 6 to 8. First, one clamping element 9 respectively is fitted on opposite sides into the groove 7 between the two side wall elements 5 and 6. By means of the elastic construction of the clamping lips 92, the clamping elements 9 are held in the groove 7 by means of a certain clamping force and with the additional sealing lips 14 resting against the side wall element 5.

Figure 7:
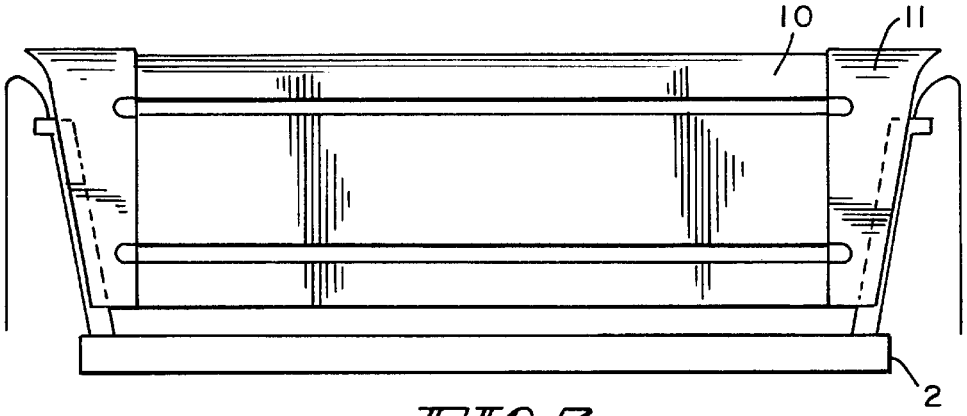
FIG. 7 is a frontal view of the separating wall of the partitioning system in the preassembled and displaceable condition.

Subsequently, the separating wall 10 with the holding elements 11 inserted therein to is fitted onto the clamping element 9 until the interior wall 112 rests against the clamping element and the underside of the separating wall 10 is arranged spaced with a gap above the bottom 2 of the drawer 1 (FIG. 7). In this position, the clamping forces at the clamping elements 9 are not so large that the separating wall would no longer be displaceable. The fitter can therefore displace the mounting unit consisting of the separating wall 10, the holding elements 11 and clamping elements 9 along the grooves 7 to position the wall at the desired depth in the drawer.

As soon as the separating wall 10 is situated in the desired position, it is pressed downward onto the bottom 2 so that the sealing lip 14 rests under the receiving device 103 on the floor and, by means of the interior wall 112, the clamping elements 9 are pressed onto the side wall elements 5 of the drawer (FIG. 8); by clamping the elastic material of the sealing lips 14 against the side wall elements 5 and the bottom 2, large holding forces are provided so that a further displacement of the separating wall 10 along the grooves 7 is prevented.

Figure 9A:
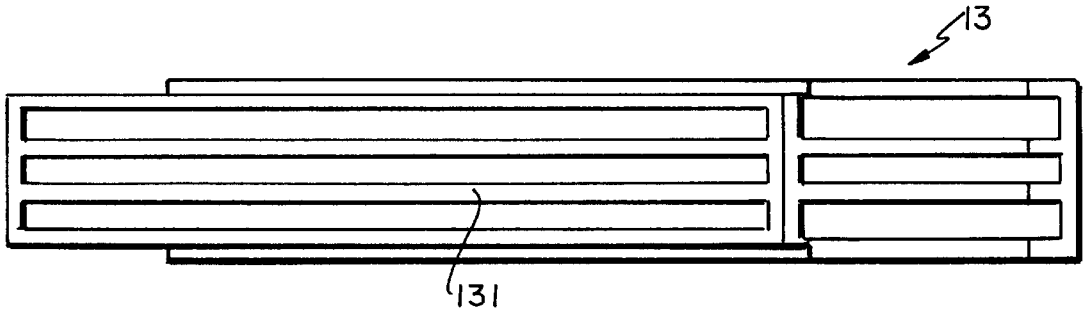
FIGS. 9A to 9C are several views of a clamping element according to another embodiment.
Figure 9B:
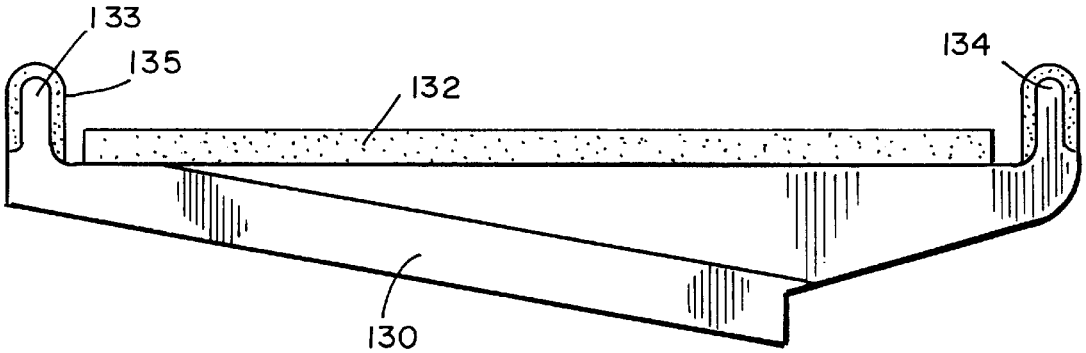
Figure 9C:
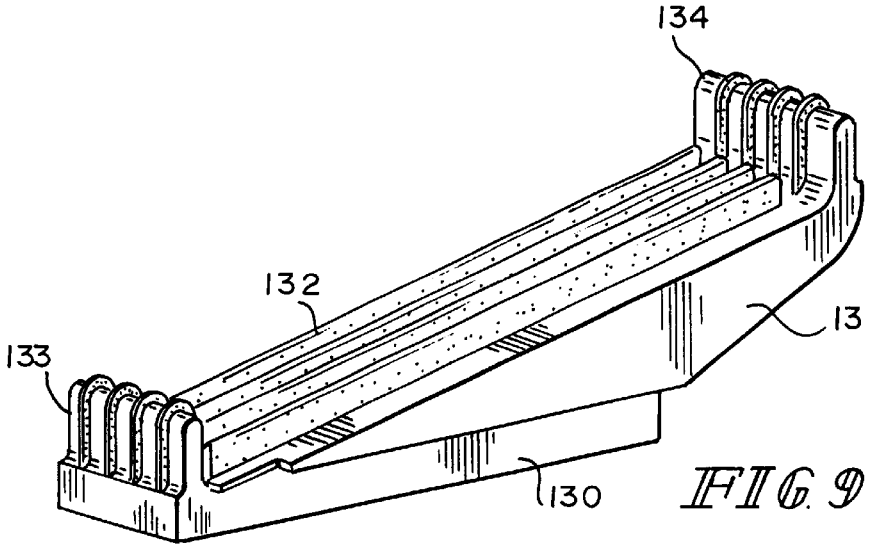

FIG. 9 shows a clamping element 13 of a partitioning system according to a second embodiment. The clamping element 13 made of plastic has several smoothly extending ribs 131 on its underside which can be used for fastening a holding element. On the side facing a side wall element, the clamping element 13 is provided with four longitudinal sealing lips 132. On both sides of the sealing lips 132, clamping tips 133 and 134 are arranged onto which projecting clamping lips 135 are formed which are made of an elastic material.

Figure 10:
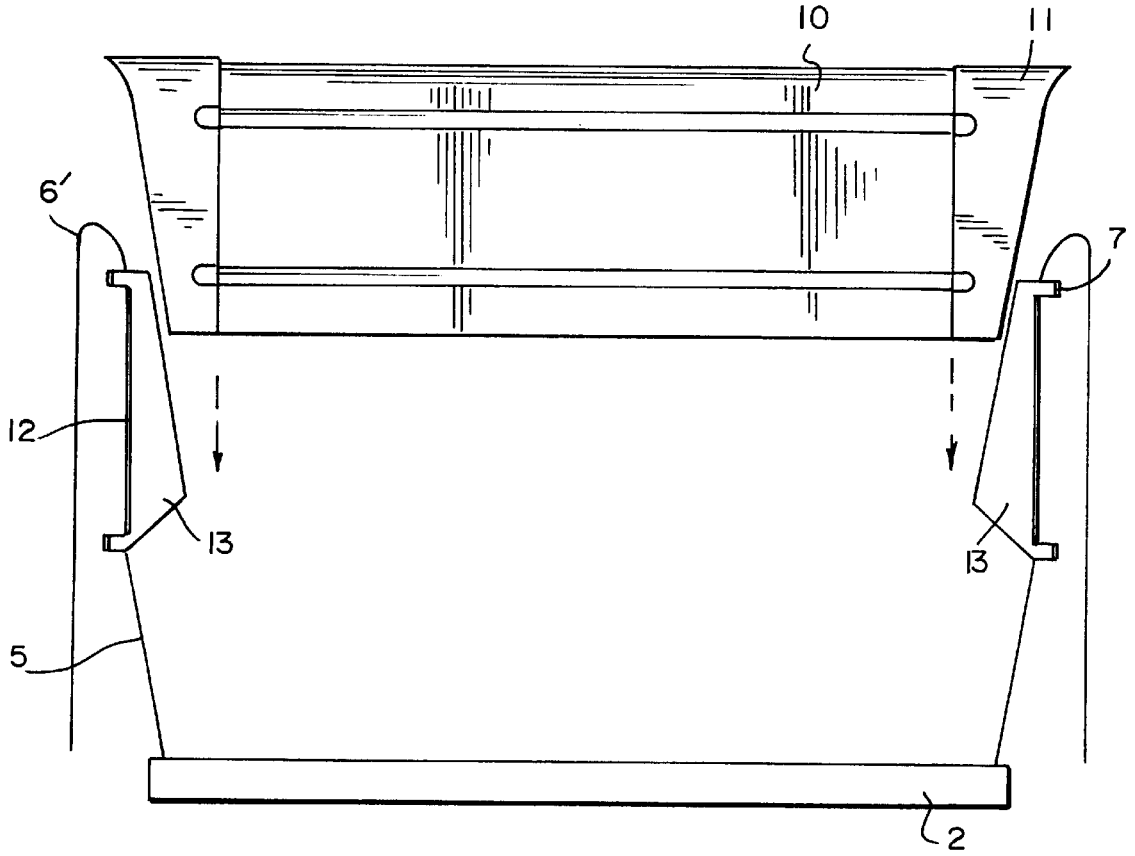
FIG. 10 is a frontal view of the separating wall of a partitioning system according to a second embodiment before the mounting.

The clamping element 13 is provided for a partitioning system, as illustrated in FIG. 10. A lower, diagonally extending side wall element 5, a vertical side wall element 12 and an upper side wall element 6' are arranged on a sliding bottom 2 of the drawer. One groove 7 respectively is provided between the side wall elements 5, 12 and 6'. For mounting a separating wall 10 with holding elements 11, a clamping element 13 is fitted into the grooves 7 on both sides of the drawer.

Figure 8:
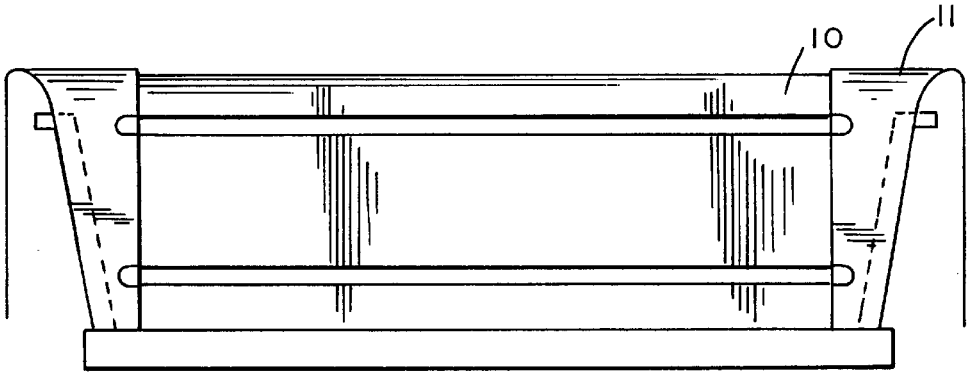
FIG. 8 is a frontal view of the separating wall of the partitioning system in the installed condition.

The fixing of the separating wall 10 will then take place by means of clamping forces, as explained in conjunction with FIGS. 7 and 8, in this embodiment, the separating wall 10 not being placed on the bottom 2 (FIGS. 11 and 12) of the drawer to provide a partial wall separator. The holding forces are therefore applied only by the clamping elements 13 which are pressed by means of the diagonally extending interior wall 112 toward the outside onto the side wall elements 12 of the drawer.

Figure 13A:
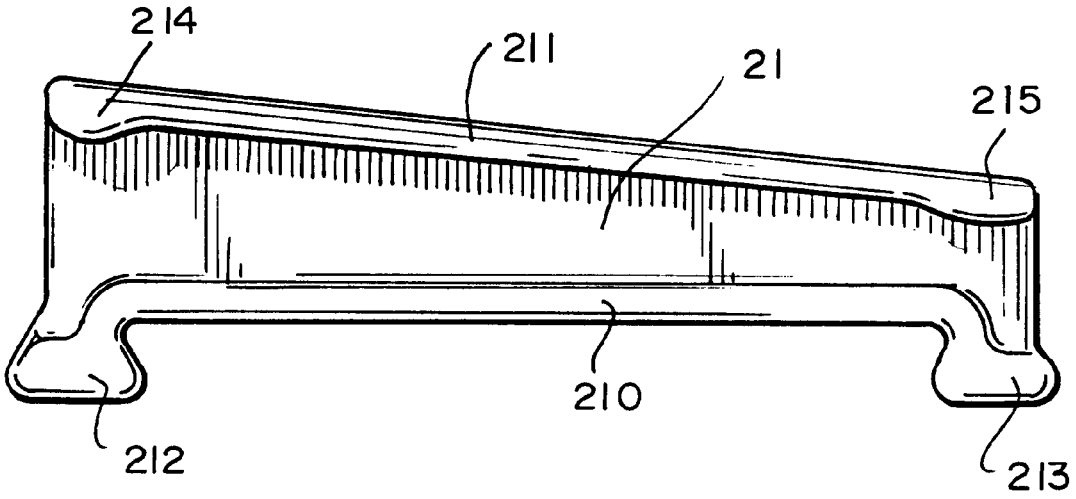
FIGS. 13A to 13B are two views of an intermediate element for fastening an intermediate wall.
Figure 13B:
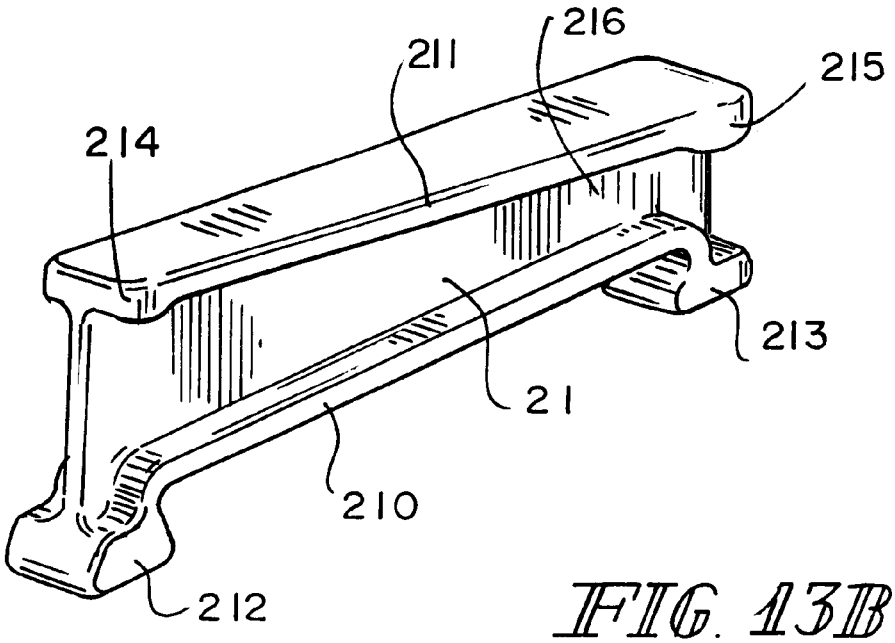

In order to be able to carry out, in the case of the partitioning system according to the invention, not only a partitioning parallel to the front panel 4 and to the rear wall 3, multiple partitioning and cross partitioning can be provided. According to FIGS. 13A and 13B, intermediate elements 21 are provided which are made of plastic and which can be fastened to a separating wall 10. Each intermediate element 21 is provided with an upper fastening foot 212 and a lower fastening foot 213 which, with respect to their shape and size, are dimensioned such that they can be introduced into the grooves 101, 102, 104 and 106. A protruding holding rib 210 extends between the two fastening feet 212 and 213. On the opposite side of the holding rib 210, a diagonally extending clamping rib 211 is provided which has thickenings 214 and 215 on its two end sides. A center web 216 extends between the holding rib 210 and the clamping rib 211.

Figure 14A:
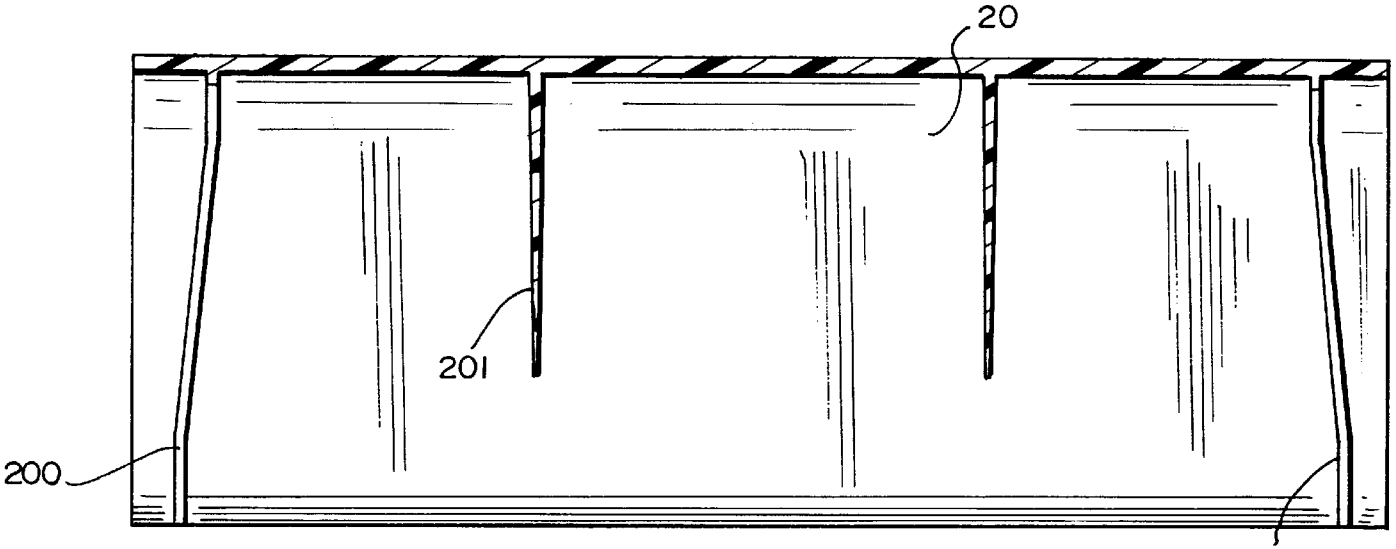
FIGS. 14A to 14C are several views of an intermediate wall.
Figure 14B:
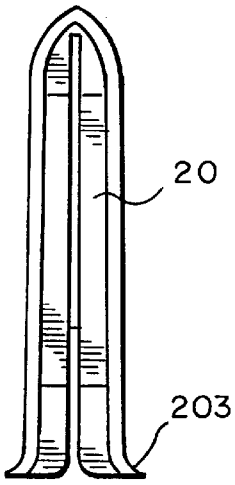
Figure 14C:
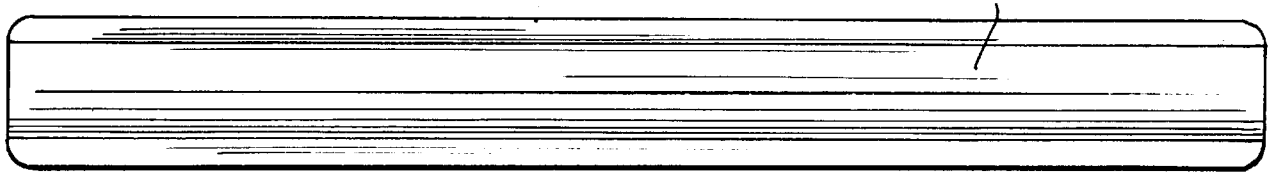

FIGS. 14A to 14C show an intermediate wall 20 which is made of a plastic material and which can be fastened on one or two intermediate elements 21. The intermediate wall 20 has an essentially U-shaped construction, one outward-extending foot 203 respectively being formed on the two legs of the U. Reinforcing ribs 201 are constructed in a center area of the intermediate wall, while one diagonally extending clamping wall 200 and 202 respectively is provided toward the exterior sides. The clamping walls 200 and 202 have a center slot which can reach around the center web 216 of the intermediate element 21.

Figure 16:
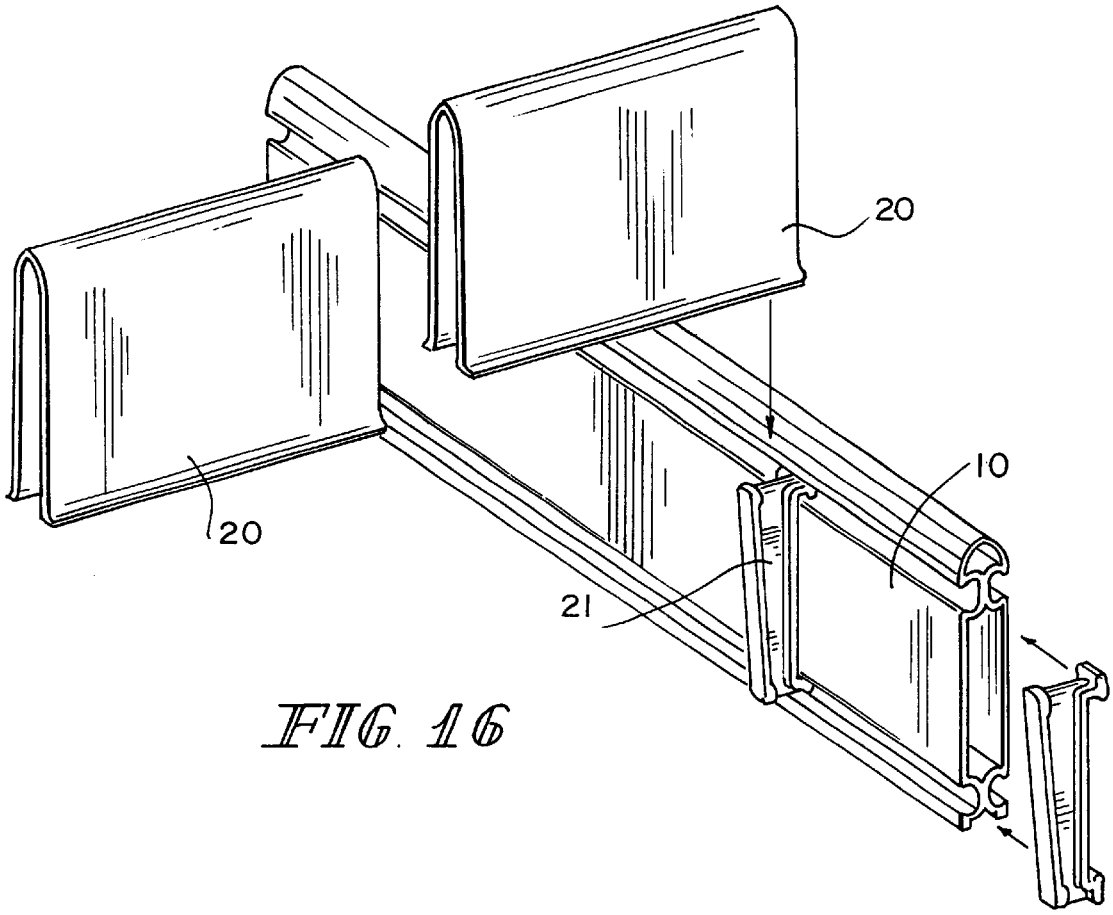
FIG. 16 is a perspective view of a separating wall with two intermediate walls during the mounting.

The method of the mounting of an intermediate wall 20 on the separating wall 10 is illustrated in FIG. 16. First, an intermediate element 21 is introduced by means of its fastening feet 212 and 213 into the grooves 101 and 102 of the separating wall 10 and is displaced into the desired position. Subsequently, an intermediate wall 20 is placed from above on the intermediate element 21, the clamping wall 202 coming to rest on the clamping rib 211. Before the intermediate wall 20 is pressed on the bottom of the drawer, the intermediate wall 20 can again be aligned along the separating wall by displacing. If the intermediate wall 20 is in the desired position, it is pressed downward, in which case the intermediate wall 20 is pressed by means of the clamping wall 202 and the diagonally extending clamping rib 211 against the separating wall 10 and is fixed on it by means of clamping forces.

Figure 17:
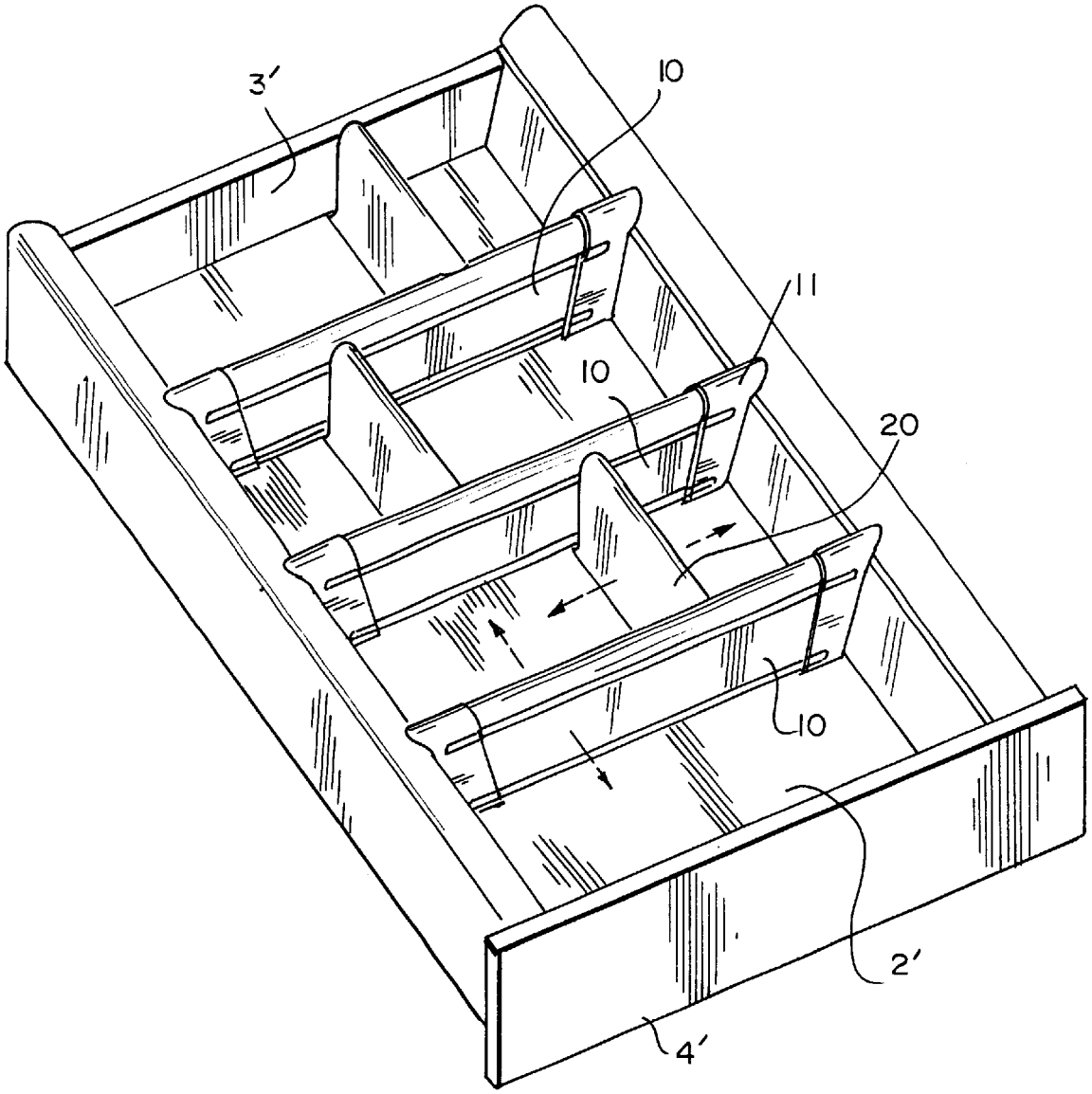
FIG. 17 is a partitioning system in a drawer according to a third embodiment.

FIG. 17 shows a drawer with a partitioning system according to the invention. Between a rear wall 3' and a front panel 4', a plurality of separating walls 10 and intermediate walls 20 are arranged which can be positioned according to the user's requirement. It is also possible to provide several intermediate walls 20 for a particularly small partitioning between two separating walls 10.

Figure 11:
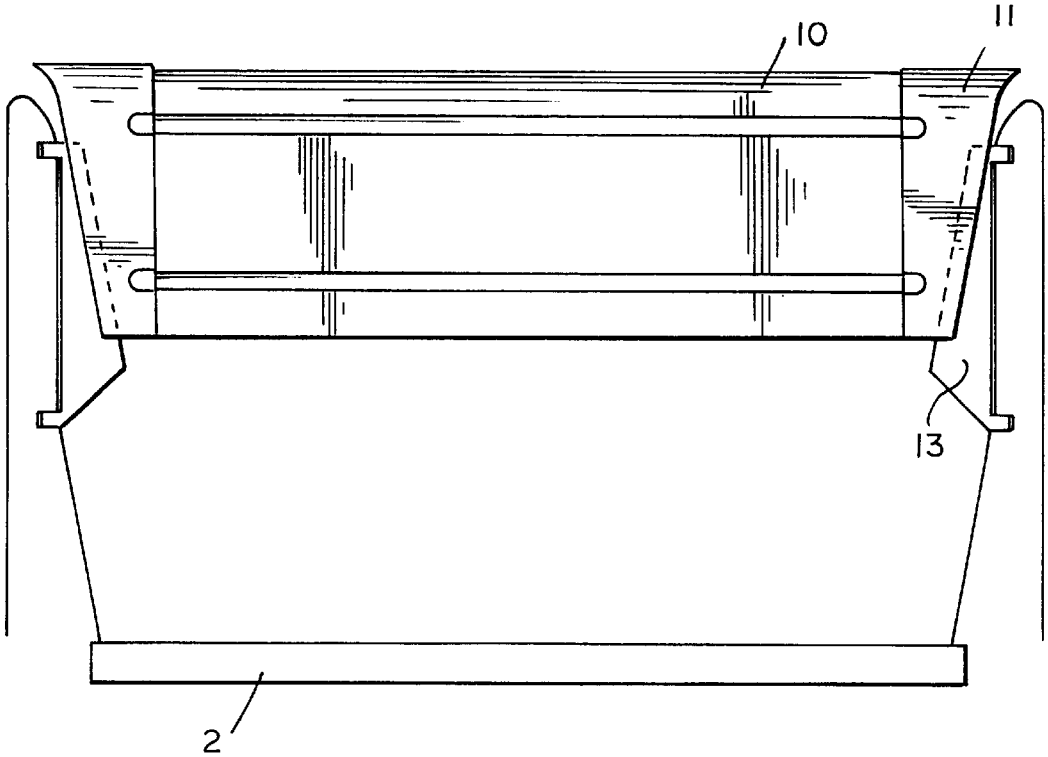
FIG. 11 is a frontal of the separating wall of the partitioning system according to FIG. 10 in the preassembled and displaceable condition.
Figure 12:
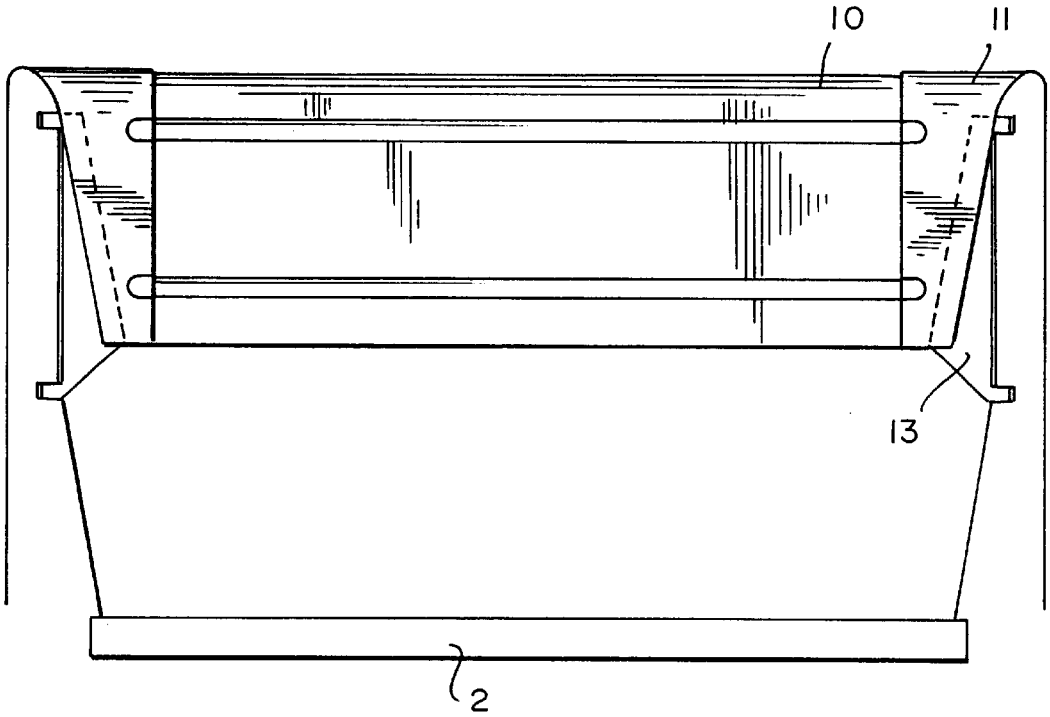
FIG. 12 is a frontal view of the separating wall of the partitioning system according to FIG. 11 in the installed condition.
Figure 15A:
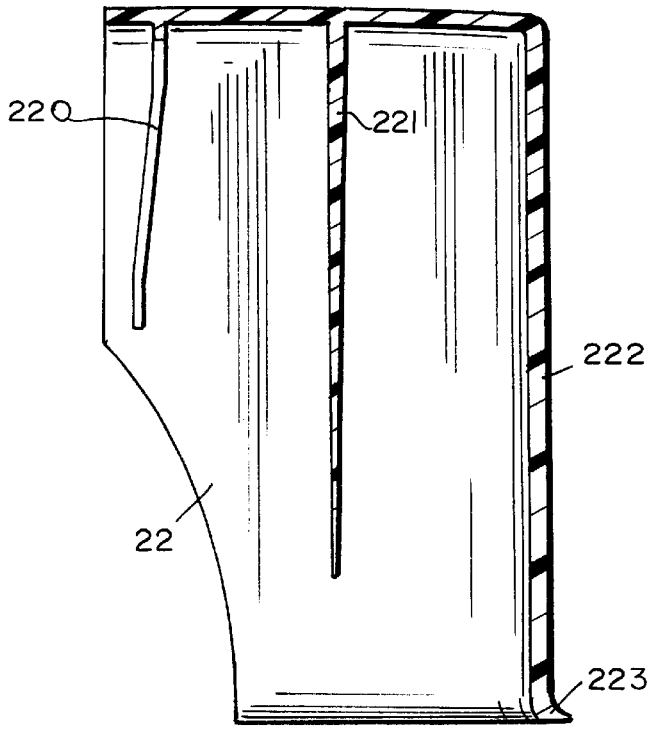
FIGS. 15A to 15C are several views of a partitioning element.
Figure 15B:
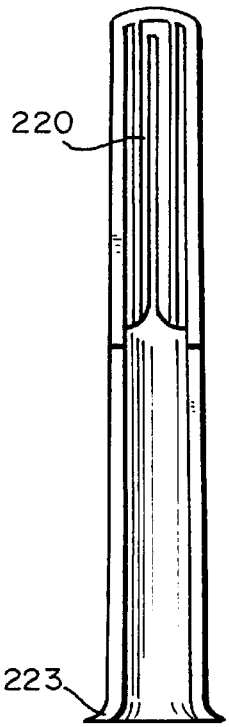
Figure 15C:
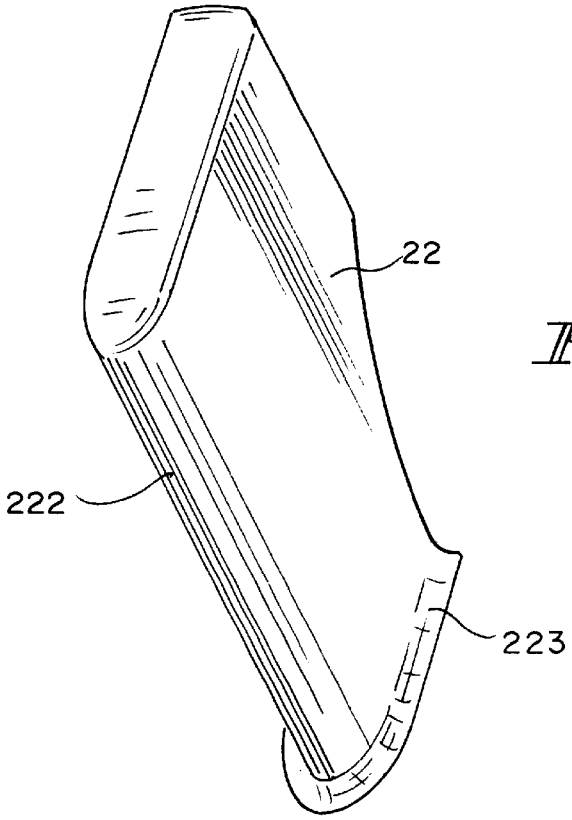

Instead of the intermediate walls 20, other partitioning systems can also be fastened on the separating wall 10. FIGS. 15A to 15C show such an example of a partitioning system 22, which can be used in connection with a drawer, as illustrated in FIGS. 10 to 12. The partitioning system 22 has a clamping wall 220 with a slot arranged in the center (FIG. 15B), which clamping wall 220 can interact with the clamping rib 211 of the intermediate element 21. The partitioning system 22 also has an edge 222 projecting into the drawer which edge 222 has an outward-bent foot 223 and a reinforcing rib 221. The partitioning system 22 can be fastened in the same manner on a separating wall 10 according to FIG. 10 as an intermediate wall 20 in the case of the embodiment illustrated in FIG. 17.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is,:

1. A positionable partitioning system for drawers, having two drawer side walls which are arranged on a floor bottom of a drawer, which extend from above downward and diagonally to the inside toward the floor bottom of the drawer-and between which side walls a drawer space is provided, comprising:

a separating wall extending between the side walls, and having connecting devices having clamping elements which can be fitted into a groove arranged on the side walls of the drawer for fixing the separating wall between the side walls of the drawer at a desired position, and wherein the separating wall, when inserted between the side walls in a first lifted position above the floor bottom, is displaceable along the side walls to a desired position prior to being moved to a second lowered position adjacent the floor bottom, which movement causes the connecting devices to stop displacement and holds the separating wall to the side walls.

2. The positionable partitioning system according to claim 1, wherein the separating wall is held in a fixed manner in the lowered position by means of clamping and friction forces.

3. The positionable partitioning system according to claim 2, wherein each clamping element has at least one sealing lip made of an elastic material on its side facing the side wall.

4. The positionable partitioning system according to claim 1, wherein each clamping element has at least one sealing lip made of an elastic material on its side facing the side wall.

5. A positionable partitioning system for drawers, having two drawer side walls which are arranged on a floor bottom of a drawer and between which side walls a drawer space is provided, comprising;

a separating wall extending between the side walls, having a sealing lip made of an elastic material on the side facing the floor bottom and having connecting devices for fixing the separating wall between the side walls of the drawer at a desired position, and wherein the separating wall, when inserted between the side walls in a first lifted position above the floor bottom, is displaceable along the side walls to a desired position prior to being moved to a second lowered position adjacent the floor bottom, which movement causes the connecting devices to stop displacement and holds the separating wall to the side walls.

6. The positionable partitioning system according claim 5, wherein the connecting devices for fixing the separating wall between the wall elements have clamping elements which can be fitted into a groove arranged on the side walls of the drawer.

7. The positionable partitioning system according to claim 6, wherein the separating wall is fitted onto the clamping elements.

8. The positionable partitioning system according to claim 6, wherein each clamping element has at least one sealing lip made of an elastic material on its side facing the side wall.

9. The positionable partitioning system according to claim 5, wherein the separating wall has devices for fastening of an intermediate wall extending perpendicularly to the separating wall.

10. The positionable partitioning system according to claim 9, wherein the devices for fastening the intermediate wall have an intermediate element fitted onto the separating wall and on which the intermediate wall is fixed.

11. The positionable partitioning system according to claim 10, wherein the intermediate wall is displaceably held in a first lifted position on a separating wall above the bottom floor during displacement, and the intermediate wall is held in a fixed manner in a second lowered position on the separating wall after displacement.

12. The positionable partitioning system according to claim 9, wherein the intermediate wall is displaceably held in a first lifted position on a separating wall above the bottom floor during displacement, and the intermediate wall is held in a fixed manner in a second lowered position on the separating wall after displacement.

13. A positionable partitioning system for drawers, having two drawer side walls which are arranged on a floor bottom of a drawer and between which side walls a drawer space is provided, comprising:

a separating wall extending between the side walls, and having connecting devices for fixing the separating wall between the side walls of the drawer at a desired position, wherein the connecting devices for fixing the separating wall between the wall elements have clamping elements which can be fitted into a groove arranged on the side walls of the drawer, wherein there are laterally arranged holding elements that partially engage in a profile of the separating wall and wherein the separating wall can be fitted onto the clamping elements, and wherein the separating wall, when inserted between the side walls in a first lifted position above the floor bottom, is displaceable along the side walls to a desired position prior to being moved to a second lowered position adjacent the floor bottom, which movement causes the connecting devices to stop displacement and holds the separating wall to the side walls.

14. The positionable partitioning system according to claim 13, wherein the connecting devices for fixing the separating wall between the wall elements have clamping elements which can be fitted into a groove arranged on the side walls of the drawer.

15. The positionable partitioning system according to claim 14, wherein each clamping element has at least one sealing lip made of an elastic material on its side facing the side wall.

* * * * *